United States Patent [19]

Heimberg

[11] 4,394,996

[45] Jul. 26, 1983

[54] DRAPERY PACKAGE

[75] Inventor: Eli Heimberg, North Dartmouth, Mass.

[73] Assignee: Cameo Curtains, Inc., New York, N.Y.

[21] Appl. No.: 290,555

[22] Filed: Aug. 6, 1981

[51] Int. Cl.[3] ..... B65H 75/06

[52] U.S. Cl. ..... 242/222; 206/49; 242/50

[58] Field of Search ..... 242/222, 50, 53, 55.16; 206/389, 390, 395, 396, 397, 403–405, 805, 812, 491, 492, 49

[56] References Cited

U.S. PATENT DOCUMENTS

| | | | |
|---|---|---|---|
| 1,192,594 | 7/1916 | Woodruff | 242/222 |
| 1,906,055 | 4/1933 | Goldsmith et al. | 242/50 X |
| 3,865,234 | 2/1975 | Kester | 206/492 |

*Primary Examiner*—Leonard D. Christian
*Attorney, Agent, or Firm*—Alan H. Levine

[57] ABSTRACT

A drapery package comprising a core member and a drapery wrapped around it. The core member has a central portion and two end sections, the first of said two end sections containing a substantially uniformly spaced gap adjacent to said central portion, and the second of said two end sections containing a tapered spaced gap adjacent to said central portion. A longitudinally fan-folded drapery has a top end, a bottom end, and a middle section therebetween, the bottom end of said drapery being inserted into the substantially uniformly spaced gap of the first end section of the core member, the middle section of said drapery being wound in spiral fashion around the length of the core member, and the top end of the wound drapery being exposed. The wound drapery is packed in a box with its top end exposed so that drapery pins can be inserted along the top margin of the drapery even before it is removed from the box. A paper band encircles each wound drapery, and a divider separates each pair of wound draperies in the box.

5 Claims, 6 Drawing Figures

FIG. 4
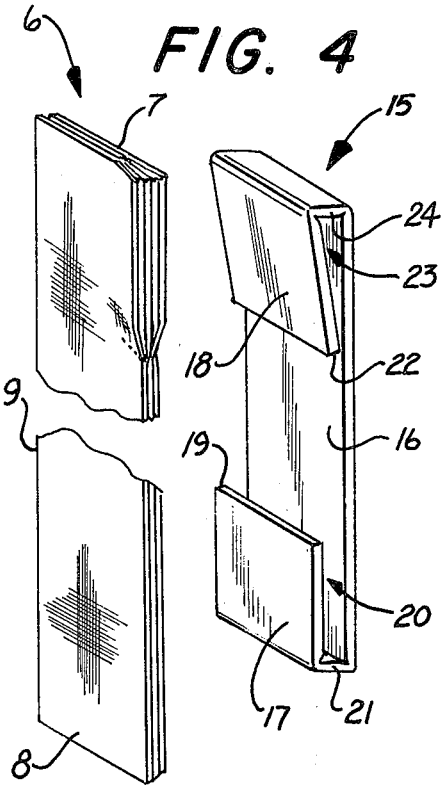
FIG. 5
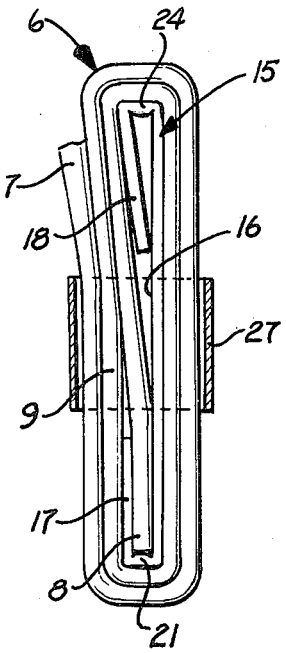
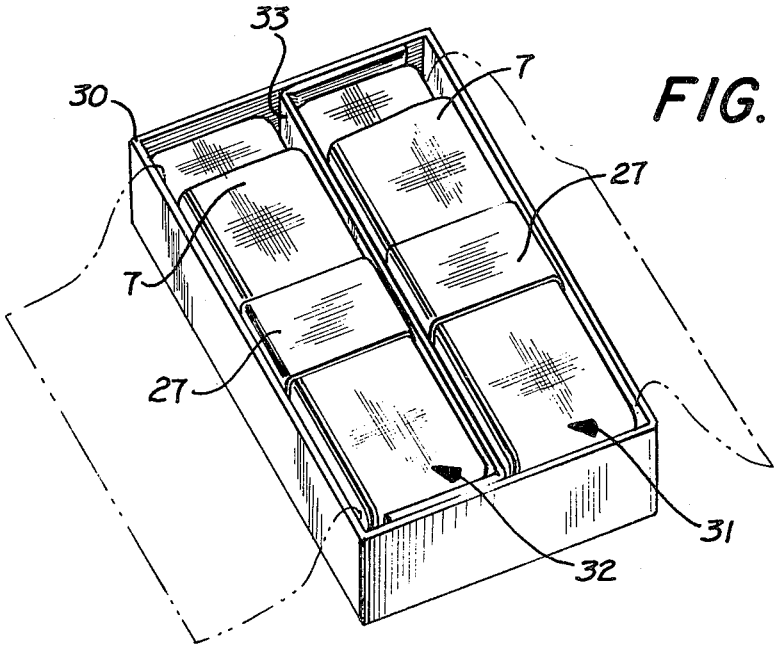
FIG. 6

DRAPERY PACKAGE

BACKGROUND OF THE INVENTION

Due to folding and packaging of curtains and draperies for shipment to, and storage in, retail stores, the curtains or draperies are very often creased, or even crushed out of shape. These misshapen goods must, upon removal from the package, be ironed in order to attempt to remove such wrinkles before the curtains or draperies can be hund or drapery rods.

Attempts have been made in the past to overcome these difficulties, and prior proposals are as follows.

U.S. Pat. Nos. 1,192,594, 1,650,051, and 3,327,844, collectively teach that a core may be formed by folding an initially flat piece of corrugated cardboard in such a way as to define an enlargement at each end of the cardboard. A fan-folded fabric would then be wrapped around this core, including the enlarged ends of the cardboard.

OBJECTS OF THE INVENTION

It is an object of the present invention to provide a first folded and then wrapped drapery which is free from wrinkles and creases, and which requires essentially no ironing after it has been first unwrapped and then unfolded.

It is an additional object of the present invention to provide a first folded and then wrapped drapery which can be hung on a drapery rod immediately after it has been first unwrapped and then unfolded.

It is another object of the present invention to provide a drapery package comprising a core member having a central portion and two end sections, one of the two end sections containing a substantially uniformly spaced gap adjacent to the central portion, and a longitudinally folded drapery having a top end, a bottom end, and a middle section therebetween, the bottom end of said drapery being inserted into the substantially uniformly spaced gap of the first end section of the core member, so as to prevent crushing of the bottom end by the remainder of the drapery which is wound on the core. Placing the bottom end of the drapery within the gap also reduces the bulk of the fully wrapped drapery.

These and further objects of the present invention will become more apparent as the description of the invention proceeds.

THE DRAWINGS

The present invention will also be described by reference to the following drawings which are not to be deemed limitative of the invention in any manner whatsoever.

FIG. 4 is a perspective view of a longitudinally folded, or fan-folded, drapery plus a core member prior to winding said drapery onto said core member;

FIG. 5 is a side view of a drapery package assembly comprising a folded drapery wound onto a core member with a securing band therearound; and FIG. 6 is a perspective view of a packing carton containing two drapery package assemblies.

DESCRIPTION OF THE INVENTION

The term drapery, as used herein, is meant to include all window covering fabrics which are to be hung upon drapery rods, such as curtains, drapes and/or liners therefor.

The drapery supporting core member is constructed from a solid material which is rigid enough to retain its shape after the drapery has been wrapped around it, so as to be able to protect the drapery from wrinkles and creases. The core member may be made of corrugated cardboard, or of suitable plastics or laminates.

The top end of the drapery is always exposed, so that S-shaped drapery pins can be inserted into the pinch pleats while the first folded and the wrapped drapery is still within its packing carton. This creates a drapery which can be hung on a drapery rod directly from the packing carton.

Figure 1:
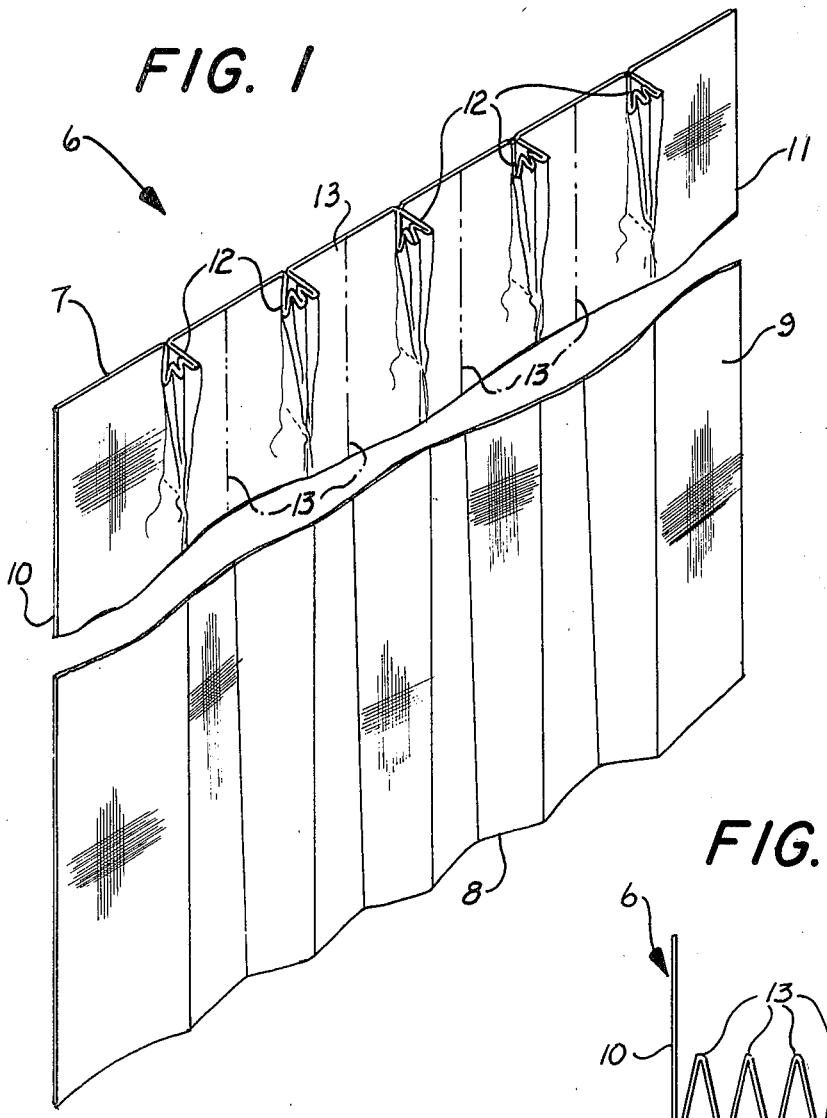
FIG. 1 is a perspective view of a drapery in an unfolded extended position for use.

Referring now to the drawings, FIG. 1 shows a perspective view of a drapery 6 in an unfolded extended condition for use, i.e., capable of being placed on a curtain rod and positioned in front of a window in a room. Drapery 6 has a pleated top end 7 containing pinch pleats 12, a smooth, or pleatless but wavy, bottom end 8, and a middle section 9 therebetween. Pinch pleats 12 are separated by connecting sections 13.

The longitudinal axis of the drapery is that centerline of the drapery which connects the pleated top end 7 with the smooth bottom end 8 of the drapery. The lateral axis of the drapery is that centerline of the drapery which connects the left side 10 of the drapery with the right side 11 of the drapery.

Figure 2:
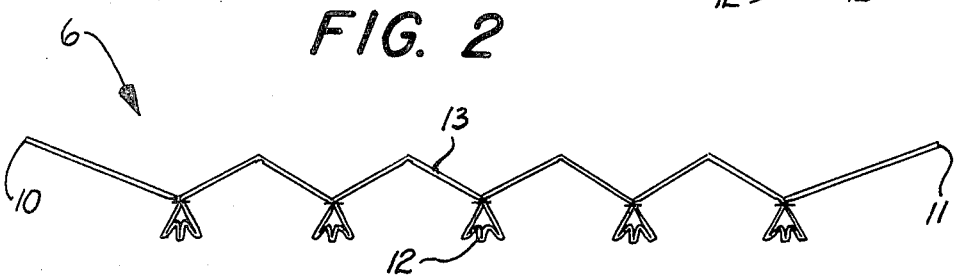
FIG. 2 is a top view of the drapery of FIG. 1.

FIG. 2 shows a top view of the drapery 6 of FIG. 1. It emphasizes that the pinch pleats 12 are important for giving to the drapery its undulating rolling appearance when the drapery is properly hung upon a drapery rod. The longitudinal axis of drapery 1 in FIG. 2 passes at right angles into and out of the plane of the paper and is located at the center of the middle pinch pleat 12.

Figure 3:
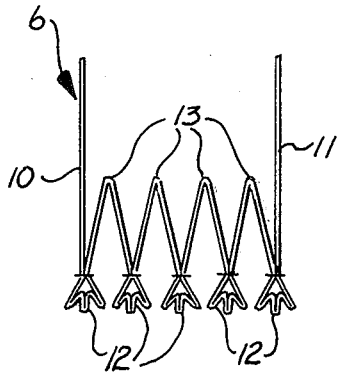
FIG. 3 is a top view of a longitudinally folded, or fan-folded, drapery.

FIG. 3 shows a top view of a longitudinally folded, or fan-folded, drapery 1. The fan-folded drapery 6 can be produced by starting with an unfolded drapery, such as drapery 6 of FIG. 1, which has been extended to its maximum width on each side of its longitudinal axis, between the left side 10 and the right side 11 of the drapery. The drapery is then contracted to its minimum width on each side of its longitudinal axis, as shown in FIG. 3. This contraction results from moving the pinch pleats 12 toward each other until they touch, or nearly touch, one another. This movement of the pinch pleats toward each other causes the connecting sections 13 of the drapery to become compressed into the accordion shape shown in FIG. 3.

The drapery 6 of FIG. 3 is said to be longitudinally folded, because it is folded in such a manner that its longitudinal axis is not diminished in length, while the width of the drapery, along its lateral axis, is reduced to a minimum.

FIG. 4 shows a perspective view of a longitudinally folded, or fan-folded, drapery 6, plus a core member 15, prior to winding the drapery onto the core member, in order to create a drapery package or assembly. Core member 15 provides a support for drapery 6. The core member has a rigid flat central portion 16 and two enlarged end sections 17 and 18 integrally connected to the flat central portion.

The first end section 17 is formed by folding one end 19 of the supporting core member 15 transversely, or back upon itself along two parallel fold lines, but without this one end touching the front surface of central portion 16, so as to create a uniformly, or a substantially uniformly, spaced gap 20 between the central portion and the one end of the first enlarged end section. Thus, this spaced gap 20 is adjacent to the central portion, and is created by being located between two essentially parallel walls, namely walls 16 and 17. Separating walls 16 and 17 is first end wall 21 which is perpendicular to both walls 16 and 17. This first end, or squared end, of the core will protect the bottom end of the drapery from being crushed out of shape or from being creased.

The second end section 18 is formed by folding the other end 22 of the supporting core member 15 transversely, or back upon itself along two parallel fold lines, until the other end 22 touches, or almost touches, the same front surface of the central portion 16, so as to create a tapered gap 23 between the central portion and the other end of the second enlarged end section. Thus, gap 23 is adjacent to the central portion, and is created by being located between two essentially intersecting walls, namely walls 16 and 18. Separating walls 16 and 18 is the second end wall 24.

In FIG. 4, drapery 14 has not yet been wound onto core member 15, but it is capable of being so wound. FIG. 5 shows a side view of a drapery package assembly comprising a fan-folded drapery 6 wrapped or wound onto a core member 15.

The assembly of FIG. 5 can be produced by starting with the longitudinally folded drapery 6 (FIGS. 3 and 4). The bottom end 8 of this drapery is inserted into the uniformly, or substantially uniformly, spaced gap 20 of the first enlarged end section 17 of supporting core member 15. The middle section 9 of the drapery, extending away from first end section 17 towards the second end section 18 of the supporting core member, is wrapped along the length of the front surface of the flat central portion 16 of the core member, and is further wrapped over and around the second enlarged end section 18. The middle section is further wrapped along the length of the rear surface of the flat central portion 16 of the core member. The middle section is then further wrapped over and around the length of the previously wrapped middle section of the drapery, until the entire length of the middle section of the drapery had been wrapped and the pleated top end 7 of the drapery lines against and is exposed on the exterior of the wound drapery.

A securing band 27, which may be made of paper, is placed around the wrapped middle section of the drapery, in order to prevent the lateral shifting of the wrapped drapery relative to its supporting core member, and prevent lateral shifting of one layer of wrapped drapery with respect to another. The inner diameter of the securing band 27 is large enough to allow this band to be slipped over the wrapped middle section of the drapery at the first enlarged rounded end section 17, and then to be moved over the wrapped middle section at the flat central portion 16 of the core member.

FIG. 6 shows a perspective view of a packing carton 30 containing two drapery package assemblies 31 and 32, each identical to the assembly of FIG. 5. The two assemblies are separated from each other by a Z-shaped divider 33, which may be formed of a strip of corrugated paperboard, or other suitable rigid material. Securing band 27 is in place around the wrapped middle section of each drapery package assembly 31 and 32. Each drapery package assembly 31 and 32 is so positioned within the packing carton 30 that its pleated top end 7 is exposed as soon as this carton is opened. This permits a person to easily insert the conventional S-shaped drapery pins (not shown) into the pinch pleats 12 of the drapery before it is even taken out of the packing carton, for the immediate hanging of the drapery on a curtain rod.

The present invention has the following advantages. When the bottom end of the drapery is placed within the uniformly spaced gap at one end of the supporting core member, the squared walls of this one end of the core member protect the bottom end of the drapery either from being creased out of shape or from being crushed out of shape. Also the bulk of the package assembly is reduced, as compared with simply wrapping a fabric around a core. The securing band, which is placed around the wrapped middle section of the drapery, also protects it against creases by preventing the lateral shifting of the wrapped drapery relative to its supporting core member. When two wrapped draperies are positioned within a packing carton and are separated from each other by a Z-shaped divider, then each wrapped drapery has its own separate compartment thereby further preventing creasing of the drapery. The drapery is wrapped around the core member in such a manner that the pleated top end of the drapery is exposed. This permits S-shaped drapery pins to be easily inserted into the pinch pleats of the drapery before it is even taken out of the packing carton. Thus, a drapery is provided which requires essentially no ironing when it is taken from the packing carton, and which can be hung on a drapery rod right from the packing carton.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

I claim:

1. A drapery package assembly comprising:

a core member having a central portion and two enlarged end sections, one of said two end sections containing a substantially uniformly spaced gap adjacent to said central portion, a longitudinally folded drapery having a top end, a bottom end, and a middle section therebetween, said bottom end of said drapery being located within said substantially uniformly spaced gap of said one end section of said core member, said middle section of said drapery being wrapped around the core member in spiral fashion, and the top end of the drapery lying against and being exposed on the exterior of the wound drapery.

2. The drapery package assembly of claim 1, further comprising a securing band placed around the wrapped middle section of said drapery.

3. The drapery package assembly of claim 1 including:

a packing carton containing two wrapped draperies, each of said two draperies being wrapped around its own core member, and a rigid divider in said carton for separating said two draperies.

4. The drapery package assembly of claim 3, further comprising a securing band around the wrapped middle section of each of said two draperies.

5. The drapery package assembly of claim 1 wherein the supporting core member has a rigid flat central portion and two enlarged end sections integrally connected to said flat central portion, and each of said two enlarged rounded end sections is formed by folding one end of said supporting core member transversely back upon itself.

* * * * *